US007034855B2

(12) United States Patent
Muto et al.

(10) Patent No.: US 7,034,855 B2
(45) Date of Patent: Apr. 25, 2006

(54) PRINTING APPARATUS

(75) Inventors: Naruhito Muto, Ama-gun (JP); Tomoki Miyashita, Nagoya (JP); Jun Jiang, Nagoya (JP); Satoru Moriyama, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/035,095

(22) Filed: Jan. 14, 2005

(65) Prior Publication Data

US 2005/0219345 A1 Oct. 6, 2005

(30) Foreign Application Priority Data

Mar. 30, 2004 (JP) ..... 2004-100588

(51) Int. Cl.
*B41J 2/355* (2006.01)

(52) U.S. Cl. ..... 347/180

(58) Field of Classification Search ..... 347/180, 347/181, 182, 13, 5, 183
See application file for complete search history.

(56) References Cited

U.S. PATENT DOCUMENTS 4,738,553 A 4/1988 Uemura et al.
5,072,237 A * 12/1991 Takaoka ..... 347/181
5,412,405 A * 5/1995 Nureki et al. ..... 347/182
5,539,433 A * 7/1996 Kawai et al. ..... 347/13
6,139,205 A * 10/2000 Suzuki et al. ..... 400/76
6,503,006 B1 1/2003 Freedman et al.
6,680,785 B1 1/2004 Nibe et al.
6,692,168 B1 * 2/2004 Ryan et al. ..... 400/76

FOREIGN PATENT DOCUMENTS

JP A 61-065665 4/1986
JP A 63-264372 11/1988
JP A 2-36956 2/1990

* cited by examiner

*Primary Examiner*—K. Feggins
(74) *Attorney, Agent, or Firm*—Oliff & Berridge, PLC

(57) ABSTRACT

The present invention provides a printing apparatus that selects a suitable speed, thereby enabling a rapid printing operation with printing quality maintained. In the printing apparatus, the number of heating elements for every printing line is counted. A printing constant speed is determined based upon the dividing number of a thermal head selected from the counting result. When the printing constant speed is changed, a corresponding numerical table is selected and set from a printing speed accelerating table and a printing speed decelerating table stored in a ROM and set for every printing constant speed.

8 Claims, 10 Drawing Sheets

FIG. 9

| ACCELERATING TABLE 1 | |
|---|---|
| LINE | PRINTING PERIOD |
| 1 | 25ms |
| 2 | 20ms |
| 3 | 10ms |
| 4 | 5ms |
| 5 | 3ms |
| 6 | 2ms |
| 7 | 1ms |
| 8 | 0.8ms |

| ACCELERATING TABLE 2 | |
|---|---|
| LINE | PRINTING PERIOD |
| 1 | 25ms |
| 2 | 20ms |
| 3 | 10ms |
| 4 | 5ms |
| 5 | 3ms |
| 6 | 2ms |
| 7 | 1ms |
| 8 | 1ms |

| ACCELERATING TABLE 3 | |
|---|---|
| LINE | PRINTING PERIOD |
| 1 | 25ms |
| 2 | 20ms |
| 3 | 10ms |
| 4 | 5ms |
| 5 | 3ms |
| 6 | 2ms |
| 7 | 2ms |
| 8 | 2ms |

| ACCELERATING TABLE 4 | |
|---|---|
| LINE | PRINTING PERIOD |
| 1 | 2ms |
| 2 | 1ms |
| 3 | 0.8ms |
| 4 | 0.8ms |
| 5 | 0.8ms |
| 6 | 0.8ms |
| 7 | 0.8ms |
| 8 | 0.8ms |

| ACCELERATING TABLE 5 | |
|---|---|
| LINE | PRINTING PERIOD |
| 1 | 2ms |
| 2 | 1ms |
| 3 | 1ms |
| 4 | 1ms |
| 5 | 1ms |
| 6 | 1ms |
| 7 | 1ms |
| 8 | 1ms |

| ACCELERATING TABLE 6 | |
|---|---|
| LINE | PRINTING PERIOD |
| 1 | 1ms |
| 2 | 0.8ms |
| 3 | 0.8ms |
| 4 | 0.8ms |
| 5 | 0.8ms |
| 6 | 0.8ms |
| 7 | 0.8ms |
| 8 | 0.8ms |

| DECELERATING TABLE 1 | |
|---|---|
| LINE | PRINTING PERIOD |
| 1 | 0.8ms |
| 2 | 1ms |
| 3 | 2ms |
| 4 | 3ms |
| 5 | 5ms |
| 6 | 10ms |
| 7 | 20ms |
| 8 | 25ms |

| DECELERATING TABLE 2 | |
|---|---|
| LINE | PRINTING PERIOD |
| 1 | 1ms |
| 2 | 1ms |
| 3 | 2ms |
| 4 | 3ms |
| 5 | 5ms |
| 6 | 10ms |
| 7 | 20ms |
| 8 | 25ms |

| DECELERATING TABLE 3 | |
|---|---|
| LINE | PRINTING PERIOD |
| 1 | 2ms |
| 2 | 2ms |
| 3 | 2ms |
| 4 | 3ms |
| 5 | 5ms |
| 6 | 10ms |
| 7 | 20ms |
| 8 | 25ms |

| DECELERATING TABLE 4 | |
|---|---|
| LINE | PRINTING PERIOD |
| 1 | 0.8ms |
| 2 | 0.8ms |
| 3 | 0.8ms |
| 4 | 0.8ms |
| 5 | 0.8ms |
| 6 | 0.8ms |
| 7 | 1ms |
| 8 | 2ms |

| DECELERATING TABLE 5 | |
|---|---|
| LINE | PRINTING PERIOD |
| 1 | 1ms |
| 2 | 1ms |
| 3 | 1ms |
| 4 | 1ms |
| 5 | 1ms |
| 6 | 1ms |
| 7 | 1ms |
| 8 | 2ms |

| DECELERATING TABLE 6 | |
|---|---|
| LINE | PRINTING PERIOD |
| 1 | 0.8ms |
| 2 | 0.8ms |
| 3 | 0.8ms |
| 4 | 0.8ms |
| 5 | 0.8ms |
| 6 | 0.8ms |
| 7 | 0.8ms |
| 8 | 1ms |

PRINTING APPARATUS

BACKGROUND OF THE INVENTION

1. Field of the Invention

The present invention relates to a printing apparatus having a thermal head that is divided into a plurality of blocks and can make a printing operation by energizing every each block, a memory that stores data for control of the printing apparatus and a control unit that performs printing control, and more particularly to a printing apparatus that can make a printing operation by selecting a suitable printing constant speed based upon a printing line.

2. Description of the Related Art

In a printing apparatus wherein print data composed of printing lines to be printed in one printing operation by a line of heating elements is stored in a print buffer, a thermal head is divided into a plurality of blocks and a printing operation is made by energizing every each block, the number of the block that is to be energized is increased or decreased according to the number of dots of the printing lines in the print data stored in the print buffer, thereby performing a printing on a printing medium.

There is a technique disclosed in Japanese patent application laid-open No. S61-65665 (1986-65665)) as a technique relating to such a printing apparatus. However, in the printing apparatus disclosed in the Japanese patent application '665, a division is made according to the print dot number for one line of heating elements to thereby perform a printing operation, so that a time for energizing the heating elements has to be secured for every number of blocks. Accordingly, the energizing time to the heating elements is required as the divided block number increases, thereby taking much time for obtaining one printed matter. Further, an extremely complicated process is required in order to make a printing operation according to the print dot number, thereby taking also much time for this process. These factors reduce a printing speed, thereby entailing a problem of taking much time for one printed matter.

Moreover, a printing speed is changed according to the number of each block, which causes excessive torque exerted on a paper feed motor for transporting a printing medium. This is a cause of wear and breakdown of the paper feed motor. There is a fear that the service life of the printing apparatus is shortened with the wear or breakdown of the paper feed motor.

SUMMARY OF THE INVENTION

The present invention aims to provide a printing apparatus having a thermal head that is divided into a plurality of blocks and can make a printing operation by energizing every each block, a memory that stores data for control of the printing apparatus and a control unit that performs printing control, and more particularly to provide a printing apparatus that can make a printing operation by selecting a suitable printing constant speed based upon a printing line.

To achieve the purpose of the invention, there is provided a printing apparatus comprising: a thermal head provided with a plurality of heating elements arranged in a line and divided into a plurality of blocks each of which is energized for printing; a memory that stores data for control of the printing apparatus; and a control unit that performs printing control, wherein the memory includes a printing information storing area that temporarily stores print data including a plurality of printing lines each of which is printed in one printing operation by one line of the heating elements and that has a capacity that is at least double the printing lines to be printed in a time required from a printing stop state to reach a maximum printing constant speed, and the control unit includes a processor for executing: a heating element number counting process for counting the number of heating elements in each printing line by looking ahead, among the print data in the printing information storing area, printing lines at least double the printing lines to be printed in the time required from the printing stop state to reach the maximum printing constant speed; a block number setting process for setting the number of the blocks to be energized in the thermal head based upon a counting result of the heating element number; and a printing speed adjusting process for selecting a printing constant speed from a plurality of printing constant speeds according to the block number set in the block number setting process, thereby adjusting the printing speed for acceleration or deceleration.

A heating element number coefficient process, block number setting process and printing speed adjusting process are executed by a processor, thereby being capable of suitably judging a printing speed corresponding to a block number of the heating elements that is to be energized and is judged for every printing line. Further, printing lines that are at least double the printing lines to be printed in a time required for obtaining a maximum printing constant speed from a stopping state is looked ahead, thereby making it possible to reduce as much as possible the change amount in the printing speed between each printing line. Therefore, a printing speed can be increased with printing quality maintained.

According to another aspect of the invention, there is provided a printing method to be executed by a printing apparatus comprising: a thermal head provided with a plurality of heating elements arranged in a line and divided into a plurality of blocks each of which is energized for printing; a memory that stores data for control of the printing apparatus; and a control unit that performs printing control, wherein the memory includes a printing information storing area that temporarily stores print data including a plurality of printing lines each of which is printed in one printing operation by one line of the heating elements and that has a capacity that is at least double the printing lines to be printed in a time required from a printing stop state to reach a maximum printing constant speed, and the method comprises: a heating element number counting process for counting the number of heating elements in each printing line by looking ahead, among print data in the printing information storing area, printing lines at least double the printing lines to be printed in a time required from the printing stop state to reach the maximum printing constant speed; a block number setting process for setting the number of the blocks to be energized in the thermal head based upon a counting result of the heating element number; and a printing speed adjusting process for selecting a printing constant speed from a plurality of printing constant speeds according to the block number set in the block number setting process, thereby adjusting the printing speed for acceleration or deceleration.

A heating element number coefficient process, block number setting process and printing speed adjusting process are executed, thereby being capable of suitably judging a printing speed corresponding to a block number of the heating elements that is to be energized and is judged for every printing line. Further, printing lines that are at least double the printing lines to be printed in a time required for obtaining a maximum printing constant speed from a stopping state is looked ahead, thereby making it possible to reduce as much as possible the change amount in the printing speed between each printing line. Therefore, a printing speed can be increased with printing quality maintained.

BRIEF DESCRIPTION OF THE DRAWINGS

FIG. 9 is a setting example of the printing speed accelerating table and printing speed decelerating table of the label printer according to the embodiment of the invention;

DETAILED DESCRIPTION OF THE PREFERRED EMBODIMENTS

Figure 1:
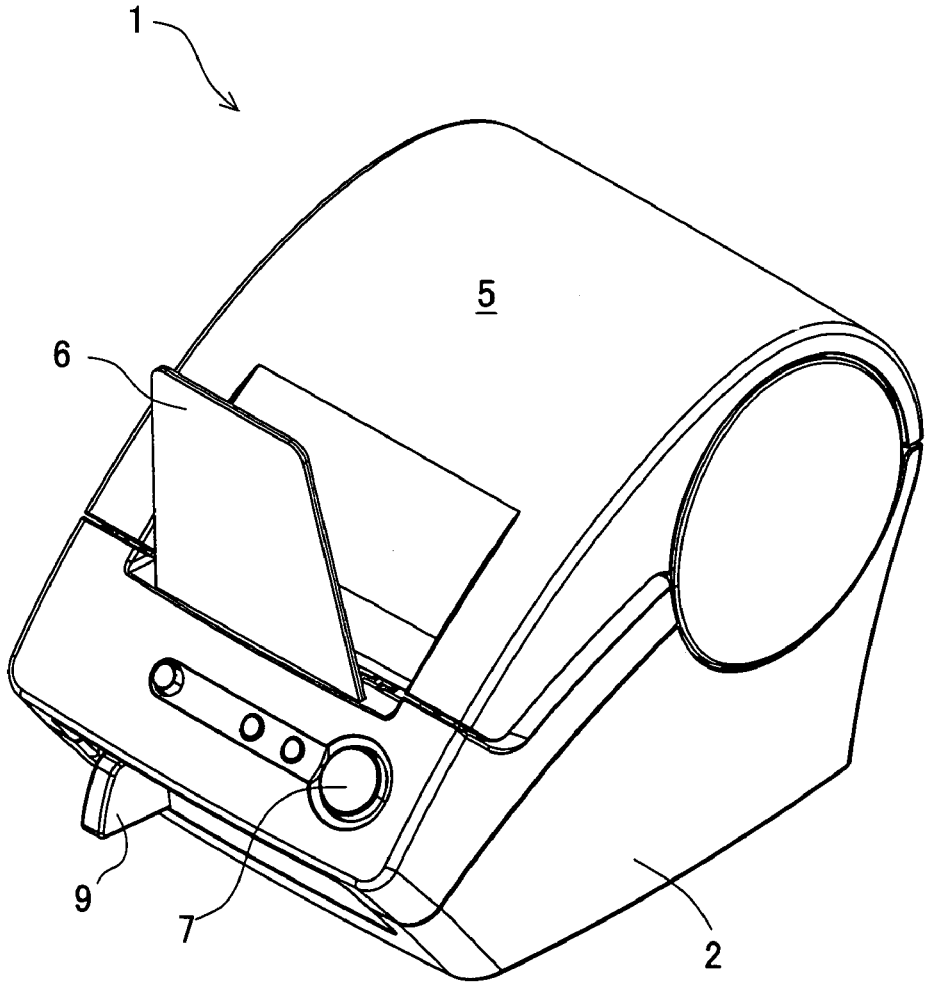
FIG. 1 is a perspective view of an appearance of a label printer according to an embodiment of the invention.
Figure 2:
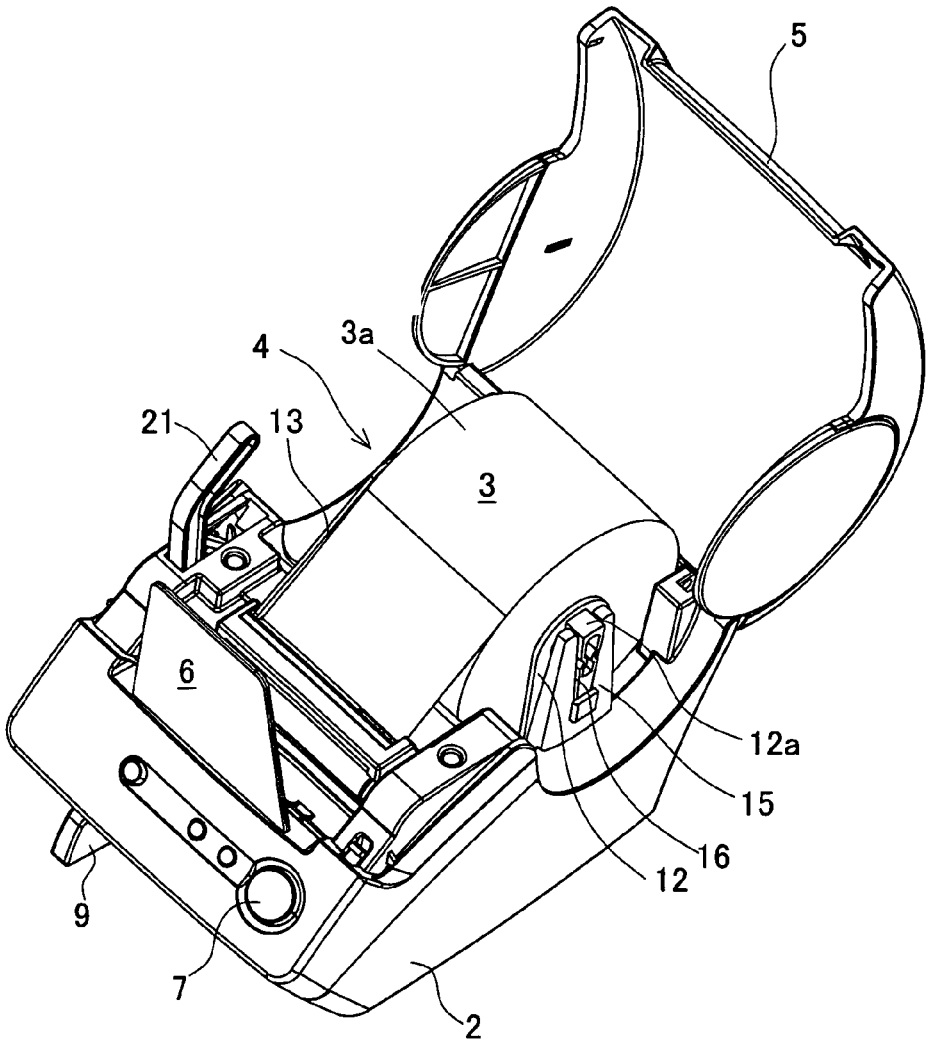
FIG. 2 is a perspective view showing a state in which a top cover of the label printer according to the embodiment of the invention is opened.
Figure 3:
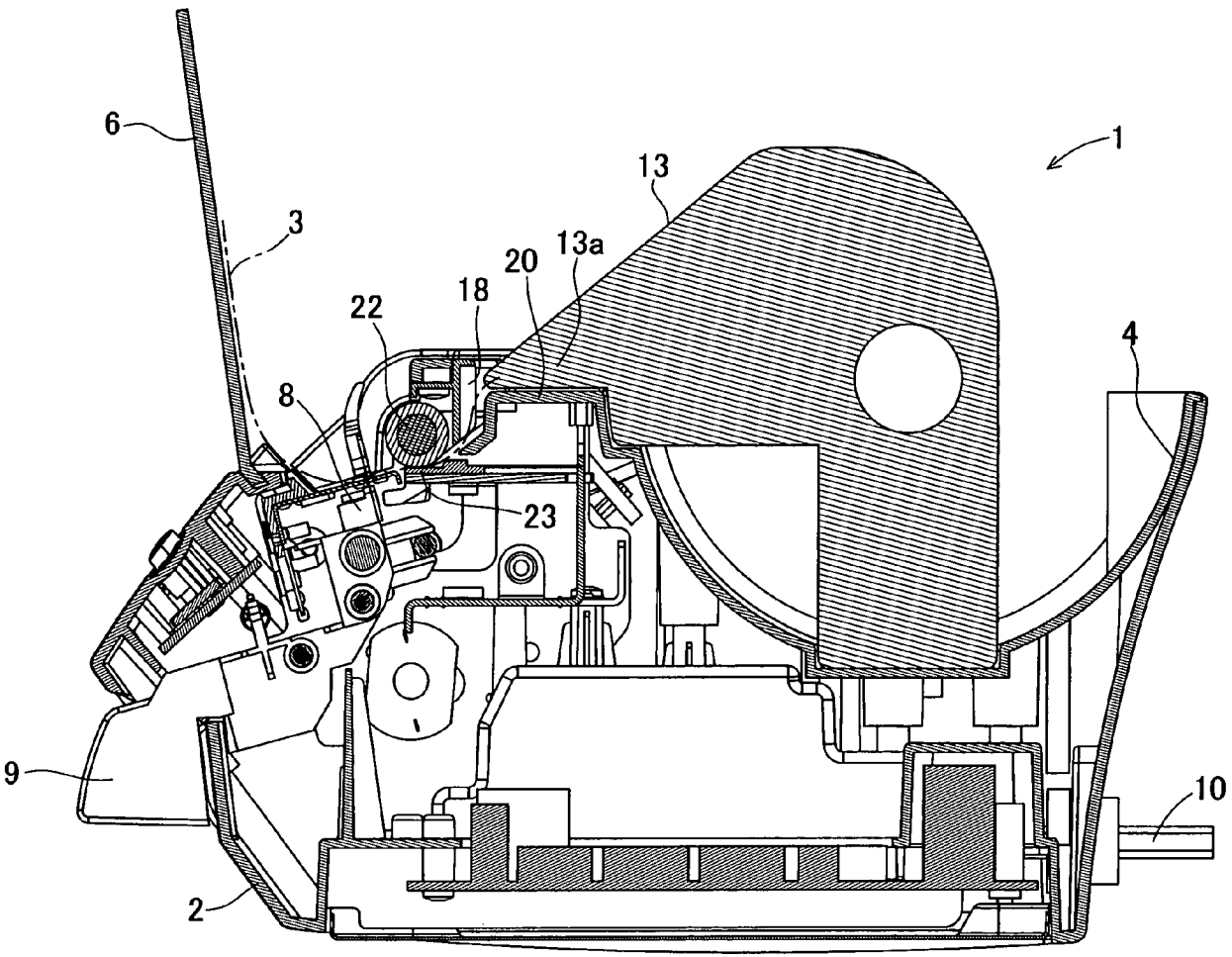
FIG. 3 is a vertical sectional side view of the label printer according to the embodiment of the invention.

Firstly, a schematic construction of a label printer according to the present embodiment will be explained in detail with reference to FIGS. 1 to 3. FIG. 1 is a perspective view of an appearance of a label printer 1 according to the present embodiment. FIG. 2 is a perspective view of an appearance of the label printer 1 with a top cover opened. FIG. 3 is a vertical sectional view of the label printer 1 seen from the side.

The appearance of the label printer 1 in the present embodiment is composed of a housing 2, a top cover 5 made of a transparent resin for covering the upper section of the housing 2 and a tray 6 made of a transparent resin provided upright at the central section at the front side of the top cover 5.

A printing medium of the label printer 1 of the present embodiment is a continuous thermosensitive sheet (so-called thermal paper) having self-coloring property or a roll sheet 3 composed of a continuous label sheet or the like obtained by sticking a released paper onto one face of the thermosensitive sheet via a pressure sensitive adhesive. The roll sheet 3 is wound around a cylindrically shaped core not shown with the printing face facing inward. The roll sheet 3 is nipped so as to be rotatable by a roll sheet holder 3*a* described later with the core as a center, and accommodated in the label printer 1.

The roll sheet holder 3*a* is composed of a supporting member 12, a guide member 13 and a shaft member 14. The shaft member 14 is provided between the supporting member 12 and the guide member 13 in such a manner that the core is passed through the shaft member 14 so as to be rotatable. A mounting piece 12*a* having substantially rectangle-shape is projectingly formed at the outer side face of the supporting member 12. An extended portion 13*a* is formed at the guide member 13. The extended portion 13*a* extends in the transporting direction of the roll sheet 3 and comes in contact with the side edge face of the roll sheet 3 for guiding the roll sheet 3 to an insertion opening 8 described later. Further, the bottom edge of the extended portion 13*a* is made horizontal to be in contact with the housing 2 for supporting the roll sheet holder 3*a*.

The housing 2 will be explained here. The housing 2 is the part of the label printer 1 for making a printing operation. Accommodated in the label printer 1 are a mechanism for the transport of the roll sheet 3, a mechanism for printing and a control mechanism of the label printer 1.

A power button 7 is arranged at the front side of the tray 6 at the front face of the housing 2. A cutter lever 9 is provided below the power button 7. Operating the cutter lever 9 moves a cutter unit 8, that is mounted in the housing so as to be movable in the left and right directions, in the widthwise direction for crossing the roll sheet 3, thereby cutting the roll sheet 3. Provided at one side edge at the back face of the housing 2 is a power code 10 for supplying electric power to be required for the printing operation of the label printer 1, and provided at the other side edge is a connector (not shown) composed of an USB (Universal Serial Bus) that is connected to a personal computer 26.

A roll sheet holder storage part 4 for accommodating the roll sheet holder 3*a* is formed in the housing 2. The roll sheet holder storage part 4 has a holder support member 15 provided upright at one side edge in the direction perpendicular to the transporting direction of the roll sheet 3. The holder support member 15 is open to the above and has a positioning groove 16 engaged with the mounting piece 12*a* of the supporting member 12 and having substantially angled U-shape seen from the front.

A flat portion 20 is formed at the upper end of the roll sheet holder storage part 4 in the transporting direction of the roll sheet 3. The flat portion 20 comes in contact with the extended portion 13*a* of the guide member 13 for supporting the roll sheet holder 3*a*. Further, the flat portion 20 extends substantially horizontal to the rear end of the insertion opening 18 to which the roll sheet 3 is inserted, and is formed to have a horizontal plane.

The roll sheet holder 3*a* is composed of the supporting member 12, guide member 13 and the shaft member 14 (not shown), so that the mounting piece 12*a* of the supporting member 12 of the roll sheet holder 3 is inserted into the positioning groove 16 of the holder support member 15 and the bottom edge face of the extended portion 13*a* of the guide member 13 is brought into contact with the flat portion 20, thereby being capable of removably mounting the roll sheet holder 3 to the roll sheet holder storage part 4.

Moreover, a lever 21 for causing up and down movement of a thermal head 23 (see FIG. 3) that performs a printing to the roll sheet 3 is provided at the front end of the other side end of the roll sheet holder storage part 4 in the transporting direction. The thermal head 23 is provided with a heating section 25 having a plurality of heating elements (not shown) provided in a line in the direction perpendicular to the transporting direction of the roll sheet 3 and divided into optional number (into three at a maximum in the present embodiment) so as to be able to supply power. Pivoting the lever 21 in the upward direction moves the thermal head 23 provided in the housing 2 in the downward direction to be separated from a platen roller 22 (see FIG. 3). Further, pivoting the lever 21 in the downward direction moves the thermal head 23 in the upward direction, thereby urging the roll sheet 3 so as to be pressed toward the platen roller 22 into a printable state. A cutter unit 8 for cutting the roll sheet 3 that is discharged into the tray 6 after completing the printing is provided below the roll sheet holder storage part 4 in the housing 2. A control circuit that drive-controls each mechanism based upon an instruction from the personal computer 26 connected via the above-mentioned connector (not shown) is provided.

The operation for bringing the label printer 1 having the above-mentioned construction into a printable state will be explained here.

Firstly, the roll sheet holder 3*a* to which the roll sheet 3 is mounted with the lever 21 pivoting in the upward direction is mounted. The mounting piece 12*a* of the supporting member 12 is fitted to the positioning groove 16 of the holder support member 15 and the bottom face of the extended portion 13*a* of the guide member 13 is brought into contact with the flat portion 20, whereby the roll sheet holder 3 is removably mounted to the roll sheet holder storage part 4. Subsequently, the roll sheet 3 is drawn out as one side edge of an drawn part of the roll sheet 3 is brought into contact with the inner surface of the guide member 13, and then, a leading end of the roll sheet 3 is inserted into the insertion opening 18 as the other side edge of the roll sheet 3 is brought into contact with the side end of the insertion opening 18. Thereafter, the top cover 5 mounted so as to be opened and closed at the rearward upper end for covering the upper side of the roll sheet holder storage part 4 is closed, thereby bringing the state shown in FIG. 1.

Then, pivoting the lever 21 in the downward direction brings the leading end of the roll sheet 3 into pressing contact with the platen roller 22 by the thermal head 23, thus entering a printable state. Specifically, pivoting the lever 21 in the downward direction pressedly urges the roll sheet 3 inserted from the insertion opening 18 toward the platen roller 22 by the line-shaped thermal head 23. Then, the thermal head 23 is heat-controlled as the platen roller 22 is rotatably driven by a stepping motor 24, whereby print data can successively be printed on the print face while the roll sheet 3 is transported.

This printing is performed on the face of the roll sheet 3 now being transported that is in pressing contact with the thermal head 23, wherein this printing face faces downward. With the printing face facing downward, the roll sheet 3 now being transported is discharged from between the top cover 5 and the housing 2 onto the tray 6, and further, the roll sheet 3 discharged onto the tray 6 is cut in its widthwise direction by the cutter unit 8 by operating the cut lever 9 so as to make a rightward movement, thereby forming a print label.

Subsequently, the control of the label printer 1 in the present embodiment will be explained in detail with reference to drawings.

Figure 4:
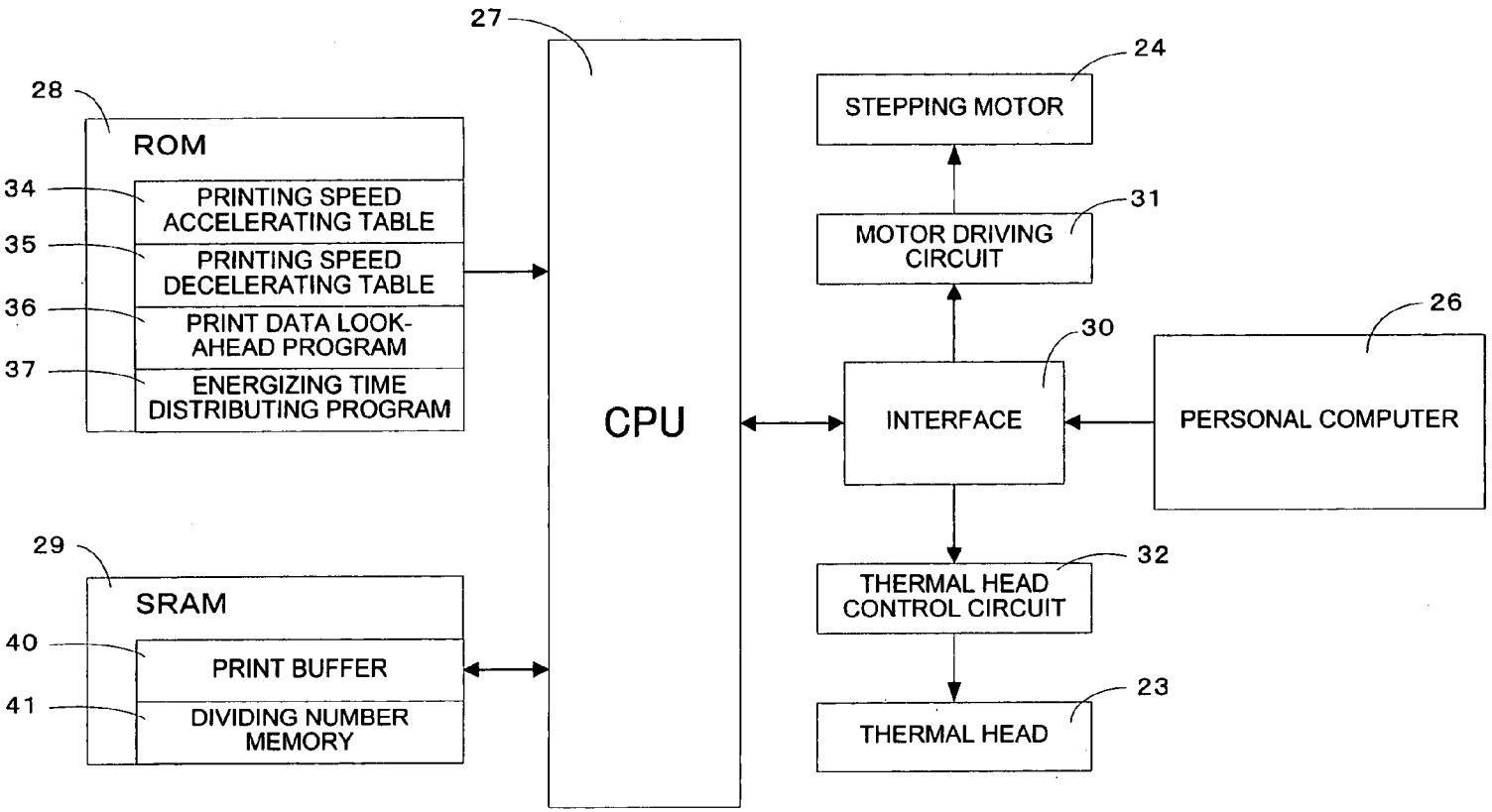
FIG. 4 is a block diagram showing the label printer according to the embodiment of the invention.

FIG. 4 is a block diagram showing a control system of the label printer 1 in the present embodiment.

The label printer 1 in the present embodiment is connected to an external device represented by the personal computer 26. It performs a label printing based upon the print data sent from the external device, thereby providing a desired label to a user. The personal computer 26 is used as the external device in the present embodiment, but the external device is not limited to the personal computer 26. It is no problem of using the other external devices such as a personal digital assistance (so-called PDA).

In the label printer 1, ROM 28, SRAM 29 and interface 30 are respectively connected to a CPU 27. Further, a motor driving circuit 31 and a thermal head control circuit 32 are connected to the CPU 27 via the interface 30. The stepping motor 24 is connected to the motor driving circuit 31 and the thermal head 23 is connected to the thermal head control circuit 32 respectively.

The CPU 27 forms the nucleus of the control of the label printer 1 and executes a printing of the label printer or calculation process relating to a printing speed control program described later. Each program executed by the CPU 27 is stored in the ROM 28. In the present embodiment, the printing speed control program, a print data look-ahead program 36 or an energizing time distributing program 37 are stored. Further, a data table to be used for the execution of the program is stored in the ROM 28. In the present embodiment, a printing speed accelerating table 34 and a printing speed decelerating table 35 are stored as the data table relating to the printing speed control program described later. Each of these data tables is explained in detail later.

On the other hand, the SRAM 29 temporarily stores data to be required for the data processing of the CPU 27. The SRAM 29 is provided with a print buffer 40 that stores the print data transmitted from the personal computer 26 and a dividing number memory 41 that records the dividing number calculated every printing line. It should be noted that the block number of the heating section 25 is equal to the dividing number in the present embodiment.

The print data in the present embodiment is composed of a plurality of printing lines, and the printing lines are print data to be printed in one printing operation by the heating section 25 composed of heating elements (not shown) arranged in a line on the thermal head 23. The print data look-ahead program 36 is a program that looks ahead the print data stored in the print buffer 40.

Figure 5:
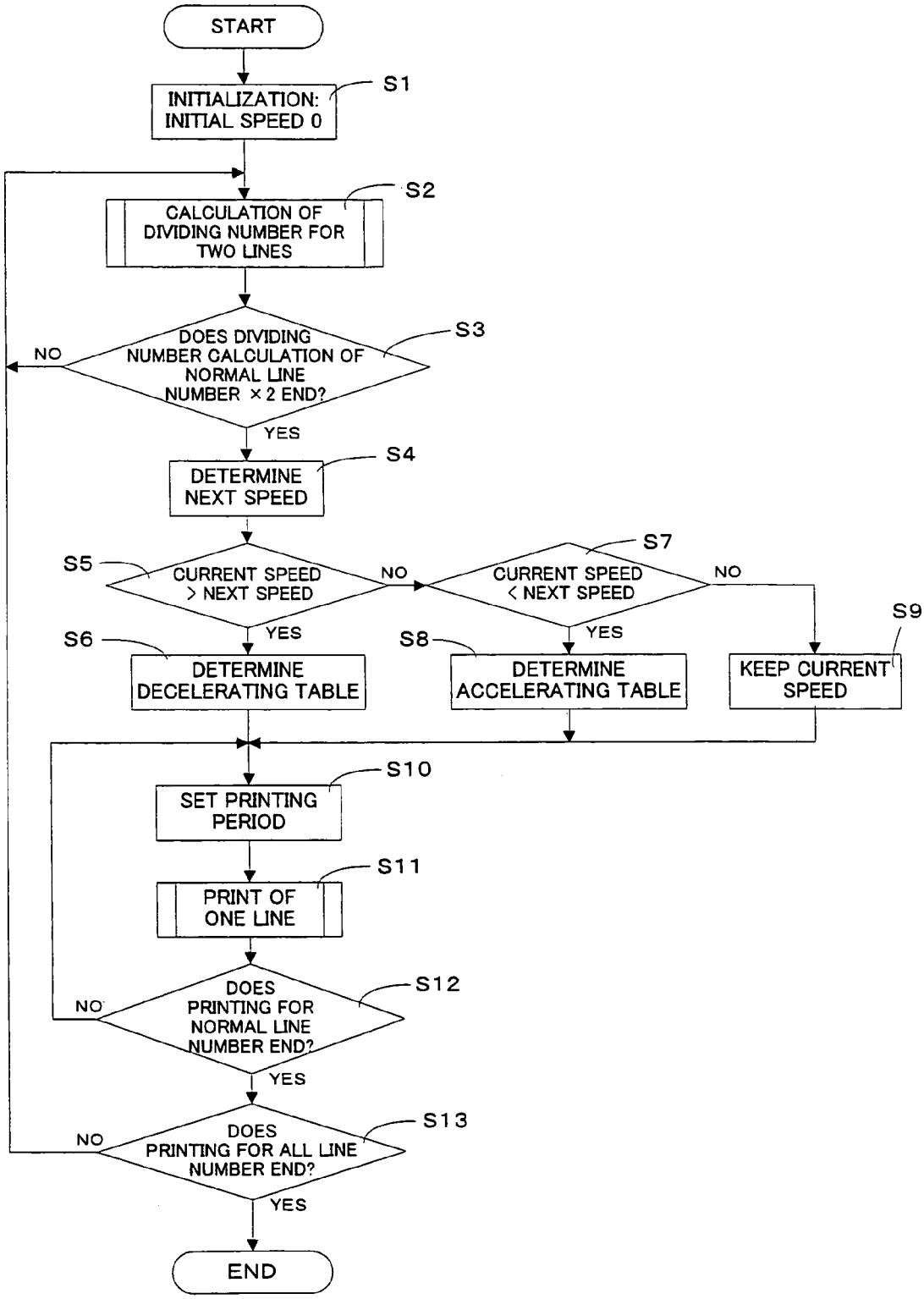
FIG. 5 is a flowchart of a basic control program of the label printer according to the embodiment of the invention.

The motor driving circuit 31 controls the stepping motor 24 (see FIGS. 4 and 5). The motor driving circuit 31 connected to the CPU 27 operates the stepping motor 24 based upon the instruction from the CPU 27 to take the transport of the roll sheet 3. In the present embodiment, the instruction is made from the CPU 27 based upon the printing speed accelerating table 34 or printing speed decelerating table 35 selected by the printing speed control program described later.

Further, the head control circuit 32 controls the heating manner of the plurality of heating elements 25*a* arranged in a line on the thermal head 23 and executes a printing operation to the roll sheet 3 based upon the instruction from the CPU 27.

In the present embodiment, the print data stored in the print buffer 40 is firstly looked ahead by the print data look-ahead program 36 stored in the ROM 28. Then, the dividing number of the heating section 25 of the thermal head 23 is judged by the number of heating elements in the printing line in the look-ahead print data. The head control circuit 32 controls the heating manner of the thermal head 23 according to the dividing number obtained by the division of the heating section 25.

Figure 8:
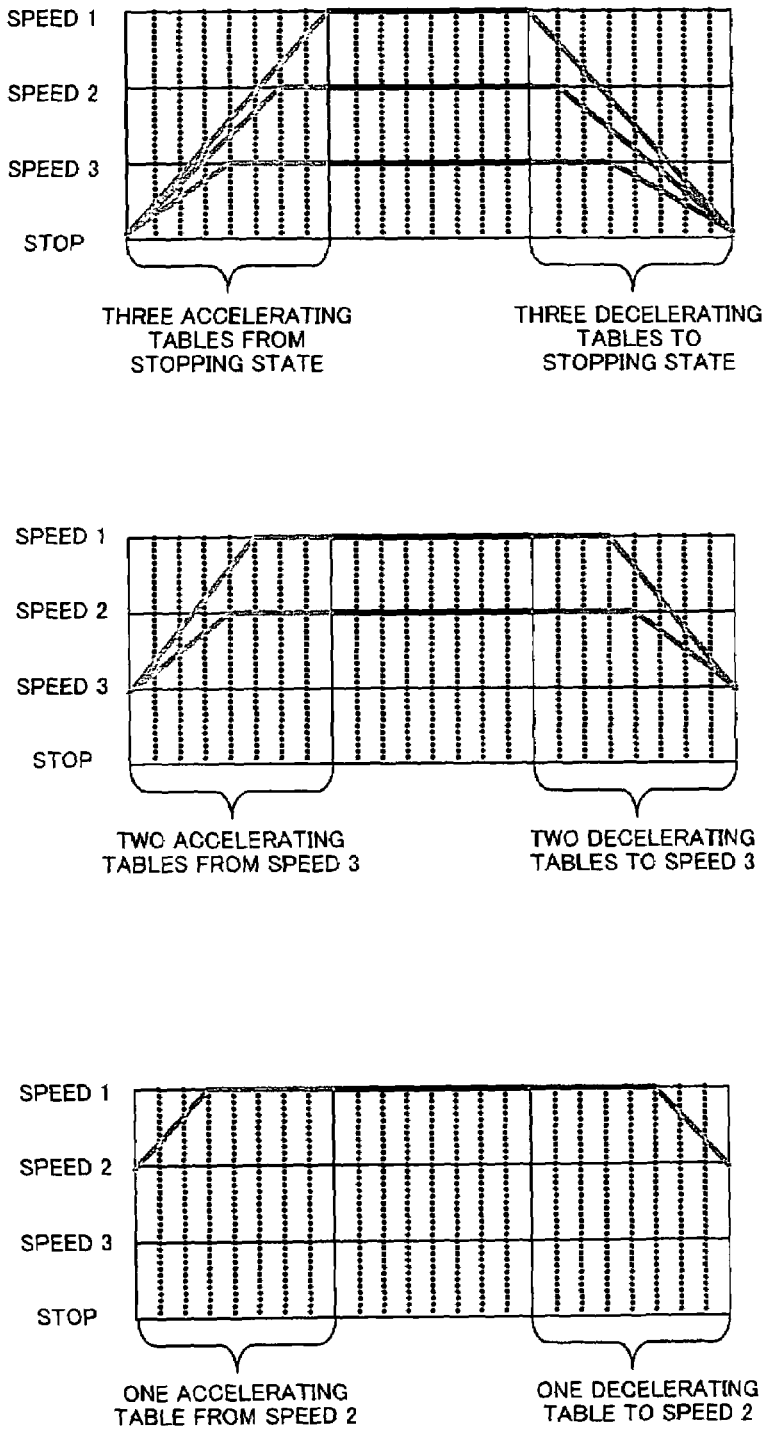
FIG. 8 is an explanatory view relating to a printing speed accelerating table and printing speed decelerating table of the label printer according to the embodiment of the invention.

Explained here in detail with reference to the drawings are the printing speed accelerating table 34 and the printing speed decelerating table 35 of the label printer 1 in the present embodiment. FIG. 8 is an explanatory view of the printing speed accelerating table 34 and the printing speed decelerating table 35 in the present embodiment. FIG. 9 is a view showing a setting example of the printing speed accelerating table 34 and the printing speed decelerating table 35.

The label printer 1 in the present embodiment selects a printing constant speed of three stages according to the dividing number of the heating section 25 arranged in a line on the thermal head 23. Further, the heating section 25 of the thermal head 23 in the present embodiment can be divided into three blocks at a maximum to be energizable. Specifically, in case where the heating section 25 is divided into three blocks, a printing constant speed (hereinafter referred to as speed 3) for performing the printing at a low speed is selected. In case where the heating section 25 is divided into two blocks, a printing constant speed (hereinafter referred to as speed 2) for performing the printing at a medium speed is selected. In case where the heating section 25 is not divided so that power is supplied to one block, a printing constant speed (hereinafter referred to as speed 1) for performing a printing operation at a high speed is selected.

As shown in FIG. 8, the label printer 1 in the present embodiment has the printing speed accelerating table 34 and the printing speed decelerating table 35 relating to the change into four printing states, i.e., a stopping state, a printing state at speed 1, a printing state at speed 2 and a printing state at speed 3. A process relating to the change in the printing speed with a simple process is performed by selecting these.

Firstly explained with reference to the drawings is the printing speed accelerating table 34. The printing speed accelerating table 34 has each accelerating table among each of an accelerating table from the stopping state to the state of speed 1, an accelerating table from the stopping state to the state of speed 2, an accelerating table from the stopping state to the state of speed 3, an accelerating table from the state of speed 3 to the state of speed 2, an accelerating table from the state of speed 3 to the state of speed 1 and an accelerating table from the state of speed 2 to the state of speed 1, that means it has accelerating tables of six types in total (see FIGS. 8 and 9).

Further, the printing speed decelerating table also has each decelerating table among each of decelerating table from the state of speed 1 to the state of speed 2, a decelerating table from the state of speed 1 to the state of speed 3, a decelerating table from the state of speed 1 to the stopping state, a decelerating table from the state of speed 2 to the state of speed 3, a decelerating table from the state of speed 2 to the stopping state and a decelerating table from the state of speed 3 to the stopping state, that means it has decelerating tables of six types in total (see FIGS. 8 and 9).

The printing speed accelerating table 34 and the printing speed decelerating table 35 are set in a range of the number of the printing lines (eight lines in the present embodiment) that are subject to the printing process during a time required for the acceleration from the stopping state to the state of speed 1. Six types of the printing speed accelerating tables and six types of the printing speed decelerating tables are formed (see FIG. 9) by setting the time required for the process of each printing line, i.e., so-called printing period. Specifically, the printing speed accelerating table 34 is set such that the more the process of the printing line advances, the shorter the printing period becomes, while the printing speed decelerating table 35 is set such that the more the process of the printing line advances, the longer the printing period becomes. This allows the acceleration or deceleration of the printing speed. Further, in case where a predetermined printing speed is achieved without waiting the process of the eight lines, it is set such that a time for processing at much higher printing speed is increased. In case where the predetermined printing speed is achieved before the process of the eight lines, the predetermined printing speed is maintained up to the process of the eight lines in the printing speed accelerating table. On the other hand, a deceleration starting point is adjusted to be set so as to obtain the predetermined printing speed at the same time of the completion of the process of the eight lines in the printing speed decelerating table.

Figure 6:
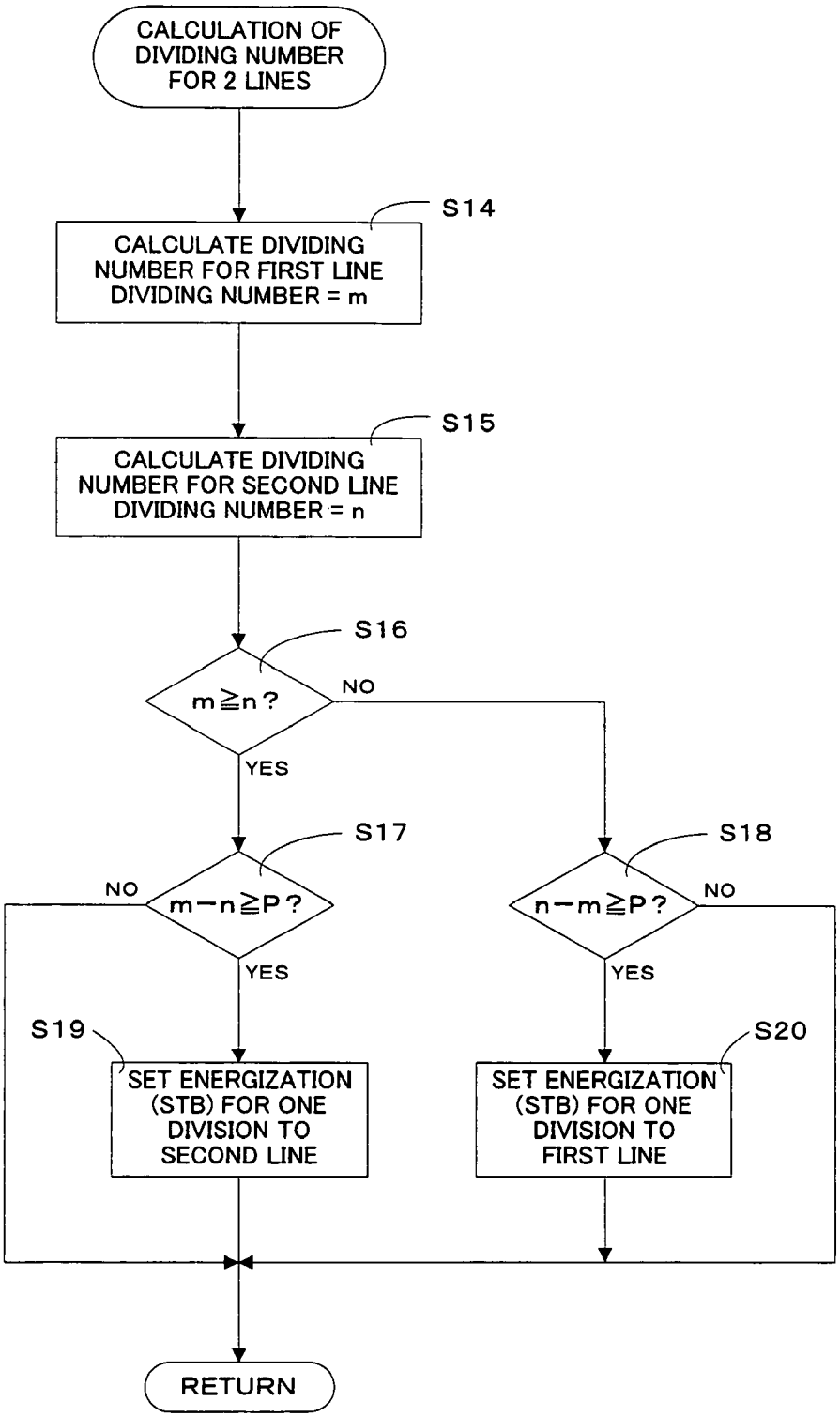
FIG. 6 is a flowchart showing a program for calculating a dividing number for two lines of the label printer according to the embodiment of the invention.
Figure 7:
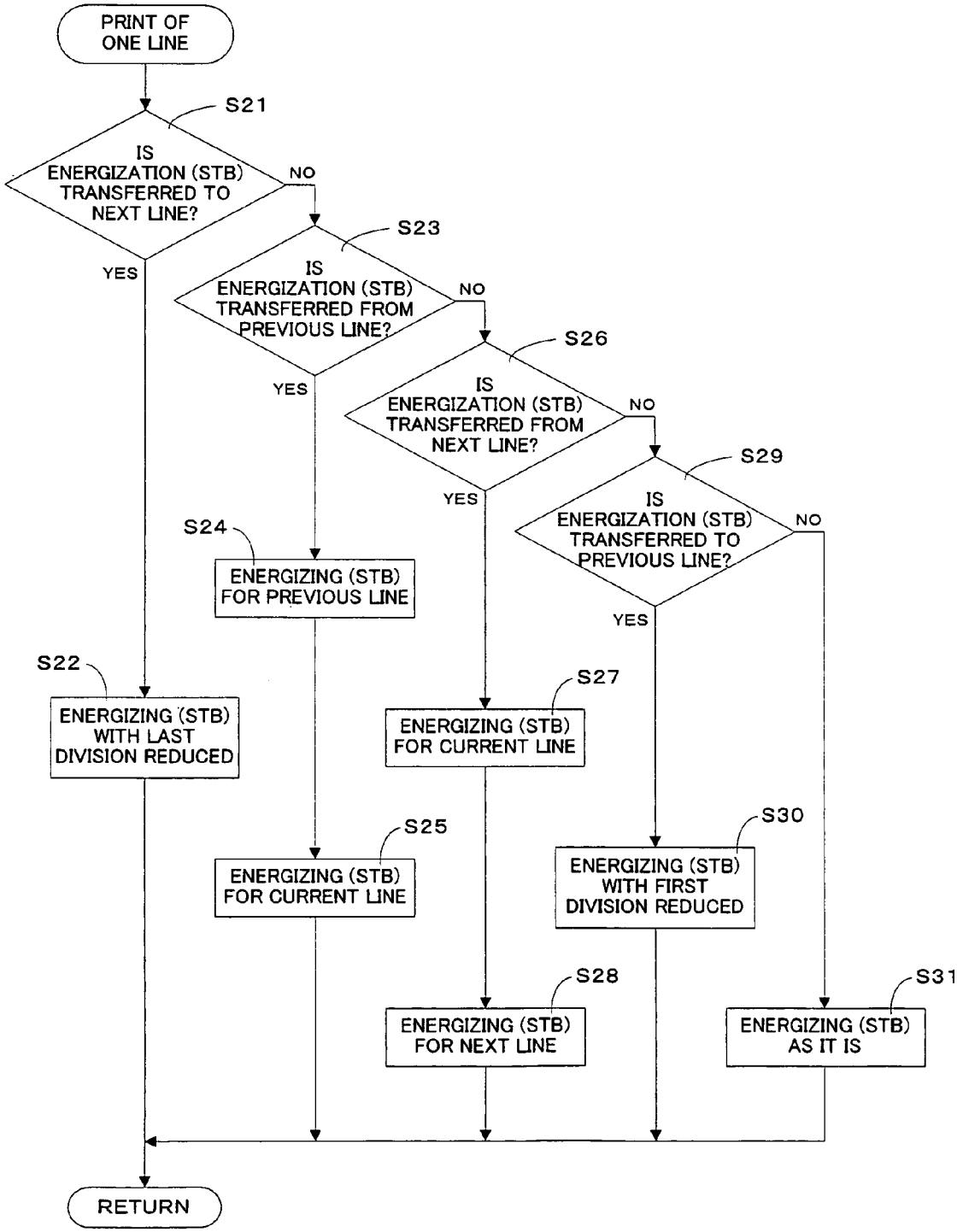
FIG. 7 is a flowchart showing a program for printing one line of the label printer according to the embodiment of the invention.

Subsequently, the operation of the label printer 1 in the present embodiment will be explained based upon FIGS. 5 to 7. Each program shown by a flowchart in FIGS. 5 and 6 is stored in the ROM 28 and executed by the CPU 27. The basic control program of the label printer 1 is firstly explained with reference to FIG. 5. FIG. 5 is a flowchart of the basic control program of the label printer 1.

When the power button 7 of the label printer 1 is pressed down, initialization is firstly performed at S1. By the initialization at S1, the printing speed is initialized to an initial value and a process for clearing each memory area is performed. After completing the initialization, the calculation of the dividing number is performed for the latest two printing lines of the print data received from the personal computer 26 and stored in the print buffer 40 (S2). The calculation of the dividing number determines the dividing number of the heating section 25 arranged in a line on the thermal head 23, thereby determining the heating manner of the thermal head 23.

A process according to the calculation of the dividing number for two lines is explained with reference to FIGS. 6 and 10. FIG. 6 is a flowchart of a program of the dividing number calculating process for two lines. FIG. 10 is an explanatory view relating to the distribution of the energizing time based upon the dividing number.

At S2, when entering the dividing number calculating process for two lines, the dividing number m of the printing line that is processed earlier (hereinafter referred to as first printing line) is calculated (S14).

In case where there are a great number of sections that are required to be printed in one printing line, the heating section 25 is divided into three, so that the dividing number is calculated to be three. In case where there are somewhat many sections that are required to be printed in one printing line, the heating section 25 is divided into 2, so that the dividing number is calculated to be 2. On the other hand, in case where there is a few sections that are required to be printed in one printing line, the heating section 25 is not divided, so that the dividing number is calculated to be 1. The calculated block number is stored in the dividing number memory 41 of the SRAM 29 so as to associate with each printing line. After the dividing number of the first printing line (hereinafter referred to as first dividing number) is calculated, the program moves to S15.

As S15, the dividing number n of the printing line that is processed next to the first printing line (hereinafter referred to as second printing line) is calculated. The calculation of the dividing number n (hereinafter referred to as second dividing number) of the second printing line is the same as the calculation of the dividing number of the first printing line, so that the second-time explanation is omitted. After the dividing number n of the second printing line is calculated, the program moves to S16.

After calculating the first dividing number m and the second dividing number n, the process relating to the distribution of the energizing time between the first and the second printing lines is performed at the process at S16 and the following.

The reason of this is as follows. In case where the dividing number of the printing line to which the printing operation is performed is great, energization to the heating elements every block and time relating to the emission from the heated heating elements are required. Therefore, the time to be required for the process for one printing line becomes long, so that the printing process cannot rapidly be executed. A judgment is made about the difference in the dividing number between the first printing line and the second printing line to thereby redistribute the energizing time between the first printing line and the second printing line, whereby the process at the first and second printing lines is changed to an optimum condition.

At first, a comparison is made at S16 as to which dividing number is great, the first dividing number m or the second dividing number n. Specifically, it is judged whether the first dividing number m is greater than or equal to the second dividing number n. When the first dividing number is greater than or equal to the second dividing number (S16: YES), the program moves to S17. When the first dividing number is not greater than or equal to the second dividing number (S16: NO), the program moves to S18.

It is judged at S17 whether the difference between the first dividing number and the second dividing number is greater than or equal to a predetermined value P. In the present embodiment, the heating section 25 of the thermal head 23 can be divided into three blocks at a maximum, so that the first dividing number m and the second dividing number n are any one of 1, 2 and 3. The predetermined value P at S17 is set to 2.

If the difference between the first dividing number m and the second dividing number n is greater than or equal to P=2 at S17, i.e., in case where m=3 and n=1 (S17: YES), the program moves to S19. On the other hand, if the difference between the first dividing number m and the second dividing number n is not greater than or equal to P=2 (S17: NO), the dividing number calculating process for two lines is ended without setting the redistribution of the energizing time.

If the difference between the first dividing number m and the second dividing number n is greater than or equal to P=2 (S17: YES), a process is performed at S19 for setting the energization for one block to the later printing line. Specifically, the energization for one block among three blocks of the first printing line is transferred to the second printing line. If this redistribution of the energization is not performed, it takes much time for the process for the first printing line, since the first printing line is divided into three blocks (see FIG. 10A, upper chart).

Figure 10A:
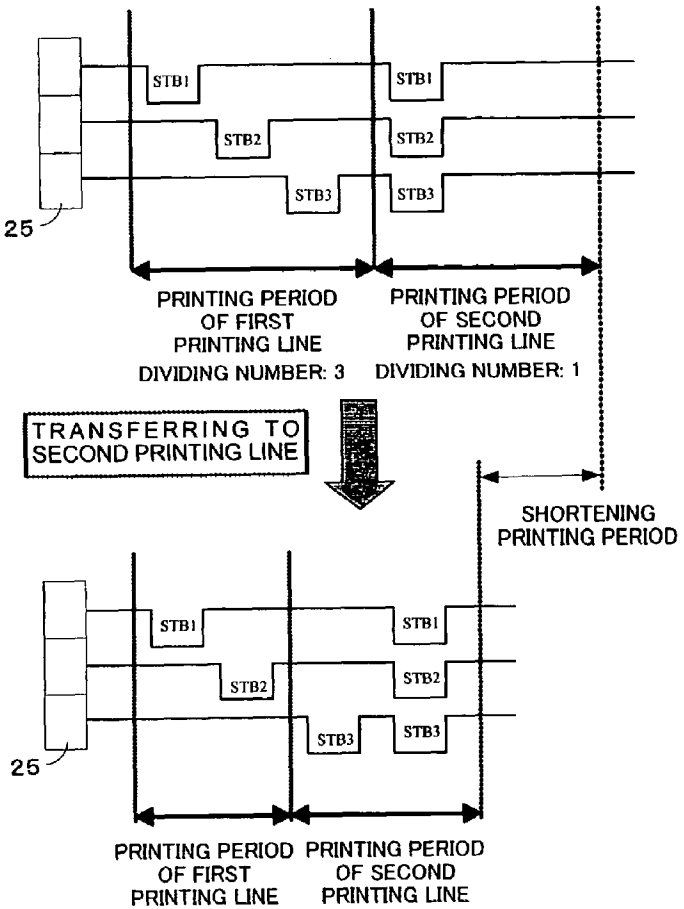
FIG. 10A is an explanatory view in case where energized block of the thermal head of the label printer according to the embodiment of the invention is transferred to a second printing line from a first printing line.

As shown in the lower chart in FIG. 10A, the printing speed of the first printing line and the second printing line is averaged by transferring the energization for one block among three blocks of the first printing line to the second printing line, thereby increasing the printing speed at both of the first and second printing lines. Further, there is no great change in the printing speed between the first and second printing lines, thereby enhancing printing quality of both printing lines. After the transition of the energization is set, the dividing number calculating process for two lines is ended.

Further, it is judged at S16 that the first dividing number is greater than or equal to the second dividing number (S16: NO), the judgment is made at S18 as to whether the difference between the second dividing number n and the first dividing number m is greater than or equal to the predetermined value P. The predetermined value P used in S18 is also P=2 like S17. If the difference between the second dividing number n and the first dividing number m is greater than or equal to P=2 at S18, i.e., if m=1 and n=3 (S18: YES), the program moves to S20. On the other hand, if the difference between the second dividing number n and the first dividing number m is not greater than or equal to P=2 (S18: NO), the dividing number calculating process for two lines is ended without setting the redistribution of the energizing time.

If the difference between the second dividing number n and the first dividing number m is greater than or equal to P=2 (S18: YES), a process is performed at S20 for setting the energization for one block to the previous printing line. Specifically, the energization for one block among three blocks of the second printing line is transferred to the first printing line. If this redistribution of the energization is not performed, it takes much time for the process for the second printing line, since the second printing line is divided into three blocks (see FIG. 10B, upper chart).

Figure 10B:
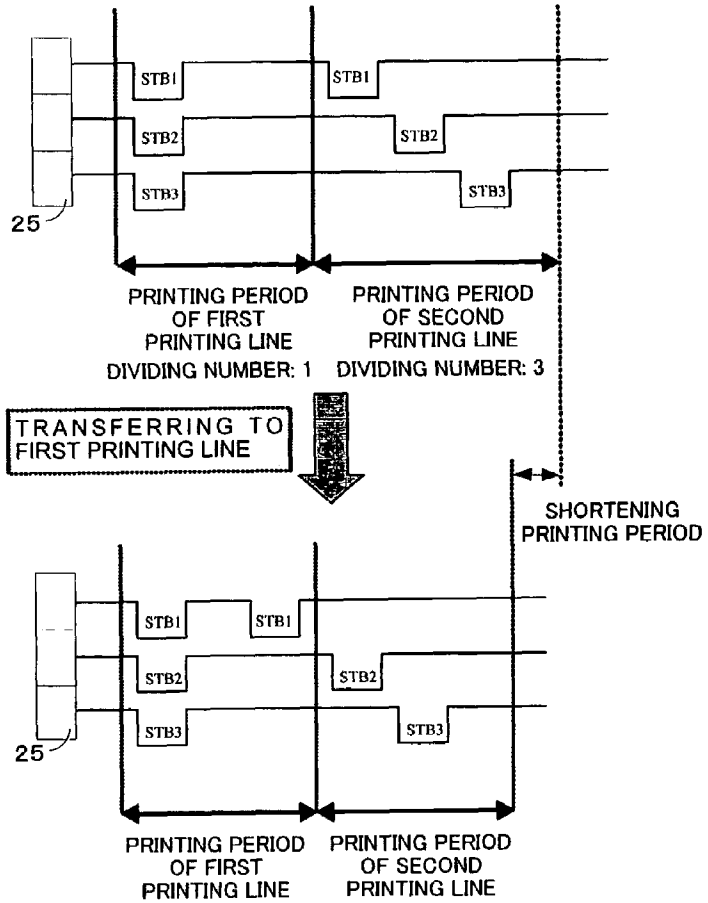
FIG. 10B is an explanatory view in case where energized block of the thermal head of the label printer according to the embodiment of the invention is transferred to a first printing line from a second printing line.

As shown in the lower chart in FIG. 10B, the printing speeds of the first printing line and the second printing line are averaged by transferring the energization for one block among three blocks of the second printing line to the first printing line, thereby increasing the printing speed at both of the first and second printing lines. Further, there is no great change in the printing speed between the first and second printing lines, thereby enhancing printing quality of both printing lines. After the transition of the energization is set, the dividing number calculating process for two lines is ended.

After the completion of the process relating to the dividing number calculation for two lines at S2, the program moves to S3. It is judged at S3 whether the calculation of the dividing number for the line number that is double the normal line number is ended or not. The normal line number in the present embodiment means a line number set by the above-mentioned printing speed accelerating table. Specifically, the normal line number is 8, so that it is judged at S3 whether the dividing number data for 16 lines is calculated or not. The dividing number data that is sufficient for the execution of accelerating or decelerating the printing speed can be obtained by calculating the dividing number for the line number that is double the line number set in the printing speed accelerating table, i.e., 16 lines.

If the dividing number for the printing line corresponding to a double of the normal line number is calculated (S3: YES), the program moves to S4. If the printing line number whose dividing number has already been calculated does not reach the normal line number (S3: NO), the program returns to S2.

The next printing speed is determined at S4 based upon the dividing number data of the line number that is calculated at S2 and S3 and is double the normal line number. In the present embodiment, the next printing speed is determined based upon the dividing number data for 16 lines. Specifically, the next printing speed is determined based upon the maximum dividing number in the dividing number data for 16 lines.

Specifically, in case where the maximum value in the dividing number data for 16 lines is 3, the next printing speed is set to "speed 1" that is the slowest printing speed, while in case where the maximum value in the dividing number data is 2, the next printing speed is set to "speed 2". In case where the maximum value in the dividing number data is 1, i.e., in case where all of the dividing number data for 16 lines is 1, it is set to "speed 3" that is the fastest printing speed. After the next printing speed is set, the program moves to S5.

The current printing speed and the next printing speed determined at S4 are compared at S5, whereby it is judged whether the current printing speed is faster than the next printing speed. If the current printing speed is faster than the next printing speed (S5: YES), the printing speed decelerating table 35 stored in the ROM 28 is referred to, whereby the decelerating table corresponding to the change in the deceleration between the current printing speed and the next printing speed is selected (S6). Then, the program moves to S10. If the current printing speed is not faster than the next printing speed (S5: NO), the program moves to S7.

The current printing speed and the next printing speed are compared at S7, whereby it is judged whether the current printing speed is slower than the next printing speed. If the current printing speed is slower than the next printing speed (S7: YES), the printing speed accelerating table 34 stored in the ROM 28 is referred to, whereby the accelerating table corresponding to the change in the acceleration between the current printing speed and the next printing speed is selected (S8). Then, the program moves to S10. If the current printing speed is not slower than the next printing speed (S7: NO), the program moves to S10 with the current printing speed maintained (S9), since the current printing speed and the next printing speed are equal to each other from the judgment of (S5: NO).

The printing period corresponding to the printing line, that is the current subject to be processed, from the printing period set for each printing line to be processed during the accelerating period or the decelerating period is set at S10 by referring to the accelerating table or the decelerating table determined at S6 and S8.

For example, if the "accelerating table 2" is selected in FIG. 9 by the process at S8, the first printing line is set to have the printing period of 25 (ms) and the second printing line is set to have the printing period of 20 (ms). Then, the printing periods of the third printing line and fourth printing line are determined, whereupon the printing periods of up to eighth printing line are determined.

When the printing line that is the current subject to be processed is the fifth line, its printing period is set to 3 (ms).

As described above, the printing periods of up to eighth lines are determined for every printing line by determining the accelerating table or the decelerating table at S6 and S8, and the printing period of the printing line that is the current subject to be processed is set at S10 from the order of the printing line that is the current subject to be processed in the accelerating table or the decelerating table and the printing period corresponding to its order. After the printing period corresponding to the printing line that is the current subject to be processed is set, the program moves to S11.

If the current speed is maintained at S9, the currently set printing period of the printing line is maintained.

The printing process is performed at S11 for every one printing line based upon the printing period set at S10. The printing process for one line is explained here in detail with reference to the drawings. FIG. 7 is a flowchart of a program of the printing process for one printing line.

When the printing process for one line is started, it is firstly judged at S21 whether the energization is transferred to the next line or not. Specifically, the judgment is made at S19 as to whether the energization to a certain block in the first printing line is set to the second printing line. If the energization is transferred to the next printing line (S21: YES), the heating section 25 arranged on the thermal head 23 is energized with the third block that is the last block in the first printing line reduced. With the energization, the print data is printed on the roll sheet 3, thereby finishing the process according to the printing process for one line. On the other hand, if the energization is not transferred to the next printing line (S21: NO), the program moves to S23.

It is judged at S23 whether the energization is transferred from the previous line or not. This is the judgment as to whether the printing line now being processed is the second printing line and whether the energization of the first printing line is judged to be transferred to the second printing line at S19. If the energization is transferred from the previous printing line (S23: YES), the block 3 transferring from the first printing line is energized (S24). Thereafter, the second printing line now being processed is energized (See FIG. 10A), thereby printing the print data on the roll sheet 3. After the printing, the process for printing one line is ended. If the energization is not transferred from the previous printing line (S23: NO), the program moves to S26.

It is judged at S26 whether the energization is being transferred from the next line in the printing line now being processed. Specifically, this is the judgment as to whether the printing line now being processed is the first printing line and whether the energization for one division of the second printing line is judged to be transferred to the first printing line. If the energization is judged to be transferred from the next line (second printing line) (S26: YES), the energization for the first printing line is firstly performed (S27), and then, the block 1 that is transferred from the second printing line is energized (S28) (see FIG. 10B). With the energization, the printing to the roll sheet 3 is finished, thereby completing the printing process for one line. If the energization is not transferred from the next line, the program moves to S29.

It is judged at S29 whether the judgment is made at S20 for transferring the energization to the previous printing line relating to the printing line now being processed. Specifically, if the printing line now being processed is the second printing line and the judgment is made for transferring the energization to the first printing line at S20 (S29: YES), the thermal head 23 is energized with the blocks in the second printing line now being processed reduced by one block (S30). After the energization, the printing process for one line is ended. If the judgment is made that the energization is not transferred to the previous printing line (S29: NO), the program moves to S31.

The process at S31 is for the case where NO answers are made at all steps of S21, S23, S26 and S29. Specifically, it is the case where the redistribution of the energization is not set with respect to the printing line now being processed, so that a thermal printing is made on the roll sheet 3 based upon the dividing number calculated at S14 or S15. After the printing, the printing process for one line is ended.

After the completion of the printing process for one line at S11 (see FIG. 7), it is judged at S12 whether the printing process for the number of the normal lines is completed or not. In the present embodiment, the number of normal lines is eight. Therefore, if the printing process for eight lines is completed (S12: YES), the program moves to S13. On the other hand, if the printing process for eight lines is not completed (S12: NO), the program returns to S10 for setting the printing period corresponding to the printing line that is the subject to be processed.

It is judged at S13 whether the printing process for all printing lines composing the print data is ended or not. If the printing process for all printing lines is ended (S13: YES), that means the print data is all printed, the basic control program of the label printer 1 is ended.

On the other hand, if the printing process for all printing lines is not ended (S13: NO), the program returns to S2 for calculating again the dividing number for two lines.

As explained above, the label printer 1 according to the present embodiment looks ahead sixteen printing lines that are double the printing period for eight printing lines set in the printing speed accelerating table 34 or the printing speed decelerating table 35, whereby the number of the heating elements of the thermal head 23 is counted to thereby determine the printing speed. Therefore, the fluctuation in the printing speed can be reduced. This eliminates a great fluctuation in the printing speed, thereby being capable of preventing the distortion in the printing result caused with the great fluctuation in the printing speed. Therefore, printing quality of the printed matter can be enhanced.

Further, in the label printer 1 according to the present embodiment, the printing speed accelerating table 34 and the printing speed decelerating table 35 that define a speed change among each printing speed are stored in the ROM 28 with respect to a plurality of printing constant speeds to be determined corresponding to the dividing number of the heating section 25 arranged on the thermal head 23 so as to be dividingly energized. When the printing constant speed is varied, the accelerating table or the decelerating table corresponding to the current printing constant speed and the next printing constant speed is only selected from the printing speed accelerating table 34 and the printing speed decelerating table 35, thereby being capable of changing the printing speed with simple process. The change in the printing speed can be achieved with simple process, thereby making it possible to shorten the processing time, resulting in being capable of enhancing a printing speed.

Moreover, in the label printer 1 according to the present embodiment, in case where there exists a printing line having some room between the adjacent printing lines, the generating energizing time is transferred to the adjacent printing line such that the energizing time for a certain divided block is distributed to the adjacent printing line according to the dividing number of the heating section 25 arranged in a line on the thermal head 23. Therefore, the time required for printing all print data can be shortened.

The present invention may be embodied in other specific forms without departing from the spirit or essential characteristic thereof.

For instance, the dividing number is calculated with respect to the printing lines double the printing lines composing the printing speed accelerating table in the present embodiment, but the dividing number may be calculated with respect to the printing lines double the printing lines composing the printing speed decelerating table, or the dividing number may be calculated from the total sum of the printing lines composing the printing speed accelerating table and the printing line composing the printing speed decelerating table.

Further, the dividing number is calculated by the printing lines double the printing lines of the printing speed accelerating table and the printing speed decelerating table, but it is not limited to that. The dividing number may be calculated by the printing lines double or more.

Although the printing speed accelerating table and the printing speed decelerating table are for eight printing lines in the present embodiment, they are not limited to eight lines. Moreover, it is not limited that the printing speed accelerating table and the printing speed decelerating table are composed of the printing lines of the same number.

Additionally, although the energization is redistributed to the previous or next line in case where the difference in the dividing number of the adjacent printing lines is greater than or equal to a predetermined value in the present embodiment, the invention is not limited to the judgment by the difference in the dividing number. For example, it is no problem that the energization is redistributed to the previous or next line in case where the difference in the printing period of the adjacent printing lines is greater than or equal to a predetermined value.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A printing apparatus comprising:

a thermal head provided with a plurality of heating elements arranged in a line and divided into a plurality of blocks each of which is energized for printing;

a memory that stores data for control of the printing apparatus; and a control unit that performs printing control, wherein the memory includes a printing information storing area that temporarily stores print data including a plurality of printing lines each of which is printed in one printing operation by one line of the heating elements and that has a capacity that is at least double the printing lines to be printed in a time required from a printing stop state to reach a maximum printing constant speed, and the control unit includes a processor for executing:

a heating element number counting process for counting the number of heating elements in each printing line by looking ahead, among the print data in the printing information storing area, printing lines at least double the printing lines to be printed in the time required from the printing stop state to reach the maximum printing constant speed;

a block number setting process for setting the number of the blocks to be energized in the thermal head based upon a counting result of the heating element number; and a printing speed adjusting process for selecting a printing constant speed from a plurality of printing constant speeds according to the block number set in the block number setting process, thereby adjusting the printing speed for acceleration or deceleration.

2. The printing apparatus according to claim 1, wherein the memory stores, between periods of the printing constant speeds, an accelerating table for making acceleration from a certain printing constant speed to another printing constant speed and a decelerating table for making deceleration from a certain printing constant speed to another printing constant speed, and the processor selects the printing constant speed from the plurality of printing constant speeds according to the block number set in the block number setting process, thereby executing the printing speed adjusting process for adjusting the printing speed for acceleration or deceleration based upon the acceleration table or the deceleration table.

3. The printing apparatus according to claim 2, wherein the processor executes a block number distributing process for making a redistribution such that the printing speeds between the printing lines are averaged, in case where a difference is present in the divided block number between the adjacent printing lines.

4. The printing apparatus according to claim 1, wherein the processor executes a block number distributing process for making a redistribution such that the printing speeds between the printing lines are averaged, in case where a difference is present in the divided block number between the adjacent printing lines.

5. A printing method to be executed by a printing apparatus comprising:

a thermal head provided with a plurality of heating elements arranged in a line and divided into a plurality of blocks each of which is energized for printing;

a memory that stores data for control of the printing apparatus; and a control unit that performs printing control, wherein the memory includes a printing information storing area that temporarily stores print data including a plurality of printing lines each of which is printed in one printing operation by one line of the heating elements and that has a capacity that is at least double the printing lines to be printed in a time required from a printing stop state to reach a maximum printing constant speed, and the method comprises:

a heating element number counting process for counting the number of heating elements in each printing line by looking ahead, among print data in the printing information storing area, printing lines at least double the printing lines to be printed in a time required from the printing stop state to reach the maximum printing constant speed;

a block number setting process for setting the number of the blocks to be energized in the thermal head based upon a counting result of the heating element number; and a printing speed adjusting process for selecting a printing constant speed from a plurality of printing constant speeds according to the block number set in the block number setting process, thereby adjusting the printing speed for acceleration or deceleration.

6. The printing method according to claim 5, wherein the memory stores, between periods of the printing constant speeds, an accelerating table for making acceleration from a certain printing constant speed to another printing constant speed and a decelerating table for making deceleration from a certain printing constant speed to another printing constant speed, and the printing speed adjusting process selects the printing constant speed from the plurality of printing constant speeds according to the block number set in the block number setting process, thereby adjusting the printing speed for acceleration or deceleration based upon the acceleration table or the deceleration table.

7. The printing method according to claim 6, further comprising:

a block number distributing process for making a redistribution such that the printing speeds between the printing lines are averaged, in case where a difference is present in the divided block number between the adjacent printing lines.

8. The printing method according to claim 5, further comprising:

a block number distributing process for making a redistribution such that the printing speeds between the printing lines are averaged, in case where a difference is present in the divided block number between the adjacent printing lines.

* * * * *